US006497731B1

(12) United States Patent
Berthelon et al.

(10) Patent No.: US 6,497,731 B1
(45) Date of Patent: Dec. 24, 2002

(54) DYED POLYAMIDE-6 ARTICLES HAVING IMPROVED WETFASTNESS PROPERTIES AND METHODS OF MAKING SAME

(75) Inventors: Natacha Berthelon, Pfastatt (FR); Dean R. Gadoury, Lake Texas, TX (US); Theodore G. Karageorgiou, Greenville, SC (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 10/166,723

(22) Filed: Jun. 12, 2002

Related U.S. Application Data

(63) Continuation-in-part of application No. 09/545,513, filed on Apr. 7, 2000, now abandoned.

(51) Int. Cl.[7] ..... D06P 5/02

(52) U.S. Cl. ..... 8/442; 8/673; 8/680; 8/685; 8/924; 8/560

(58) Field of Search ..... 8/442, 560, 924, 8/673, 680, 685

(56) References Cited

U.S. PATENT DOCUMENTS 3,652,200 A * 3/1972 Miyasaka
4,381,186 A 4/1983 Magni et al.
4,444,563 A 4/1984 Abel
4,668,241 A 5/1987 Magni et al.
4,668,421 A * 5/1987 Magni et al.
4,832,699 A 5/1989 Choi et al.

* cited by examiner

*Primary Examiner*—Margaret Einsmann
(74) *Attorney, Agent, or Firm*—Nixon & Vanderhye PC

(57) ABSTRACT

Polyamide-6 articles exhibit dramatically improved dye bleed and perspiration performance characteristics, as well as reduced color change of fluorescent dyed polyamide-6. These improvements are achieved according to the present invention by modifying conventional dyeing and aftertreatment conditions. That is, conventional temperatures used for dyeing and the aftertreatment of polyamide-6 yarns are typically about 100° C. and 77° C., respectively. In contrast, the dyeing and aftertreatment procedures of this invention are carried out at about 80° C. or lower, and about 5° C. or lower, respectively. Bath ratios of between about 15:1 to about 20:1 are employed with the polyamide-6 article being retained in the bath sufficient to achieve about 75% dye uptake.

8 Claims, No Drawings

DYED POLYAMIDE-6 ARTICLES HAVING IMPROVED WETFASTNESS PROPERTIES AND METHODS OF MAKING SAME

This application is a continuation-in-part of application Ser. No. 09/545,513, filed Apr. 7, 2000, now abandoned the entire content of which is hereby incorporated by reference in this application.

FIELD OF THE INVENTION

The present invention relates generally to a dyed polyamide articles (e.g., fibers, yarns, fabrics and the like) having markedly improved wetfastness properties. In particular, the present invention relates to dyed polyamide 6 articles and methods of making the same which result in improved wetfastness and colorfastness properties.

BACKGROUND AND SUMMARY OF THE INVENTION

Polyamide (nylon) polymers such as, for example, polyamide-6 and polyamide-6,6 are commonly used in the production of fibers and yarns for elastic fabrics, especially swimwear. When textile fibers and yarns made of polyamide-6 are used for elastic fabric applications, they exhibit a wetfastness problem. More specifically, elastic fabrics made from polyamide-6 have a poorer dye bleed performance in water and a poorer colorfastness to laundering and perspiration than elastic fabrics made from polyamide-6,6.

Broadly, the present invention improves the wetfastness properties of polyamide-6 articles and decreases the bluing of Acid Red 52 upon aftertreatment and laundering while reducing processing costs (e.g., by reducing the energy and time of such treatments as compared to conventional polyamide-6 fibers). More specifically, the present invention is embodied in polyamide-6 articles having dramatically improved dye bleed and perspiration performance characteristics, as well as reduced color change of fluorescent dyed polyamide-6.

These improvements are achieved according to the present invention by modifying conventional dyeing and aftertreatment conditions. That is, conventional temperatures used for dyeing and the aftertreatment of polyamide-6 yarns are typically about 100° C. and 77° C., respectively. In contrast, the dyeing and aftertreatment procedures of this invention are carried out at about 80° C. or lower (e.g., between about 70° C. to about 80°), and about 50° C. or lower (e.g., between about 20° C. to about 50° C.), respectively. Bath ratios of between about 15:1 to about 20:1 are employed with the polyamide-6 article being retained in the bath sufficient to achieve at least about 75% dye uptake, and more preferably between about 75% to about 80% dye uptake.

These and other aspects and advantages will become more apparent after careful consideration is given to the following detailed description of the preferred exemplary embodiments thereof.

DETAILED DESCRIPTION OF THE INVENTION

To promote an understanding of the principles of the present invention, descriptions of specific embodiments of the invention follow, and specific language is used to describe the same. It will nevertheless be understood that no limitation of the scope of the invention is intended by the use of this specific language and that alterations, modifications, equivalents, and further applications of the principles of the invention discussed are contemplated as would normally occur to one of ordinary skill in the art to which the invention pertains.

The polyamide-6 that may be employed in the practice of the present invention may be made by hydrolytically polymerizing polyamide-6 forming monomers such as, for example, poly(epsilon-caprolactam) in the presence of water and a carboxylic acid chain regulator. The carboxylic acid chain regulator is added in an amount ranging from about 0.01 to about 0.50 weight percent. Preferably, the amount of carboxylic acid chain regulator added is between about 0.05 and about 0.40 weight percent. Water is preferably used as a polymerization initiator. The amount of water used as an initiator may vary but is typically about 0.40 weight percent based on the weight of the polyamide-6 forming monomers.

The polyamide 6 may be formed into various shaped articles, such as, for example, fibers, yarns, textile fabrics, and the like. Fibers may be formed by subjecting the polyamide-6 to any conventional fiber-forming process such as, for example, that disclosed in U.S. Pat. No. 4,983,448 to Karageorgiou and U.S. Pat. No. 5,487,860 to Kent et al., each being expressly incorporated hereinto by reference. Similarly, fabrics may be formed by subjecting the polyamide-6 to any conventional fabric-forming process such as, for example, the process disclosed in U.S. Pat. No. 4,918,947 to Speich, the entirety of which is expressly incorporated hereinto by reference.

The polyamide-6 fibers and/or fabric may then be subjected to dyeing and aftertreatment in accordance with the present invention. The polyamide-6 articles may be dyed with conventional dyes used to dye polyamides, for example, metallized and non-metallized acid dyes. Dyeing may occur in fiber form such as in stock dyeing of filament staple, tow, tops, or sliver. Dyeing may also occur in fabric form such as woven, non-woven, or knitted goods or in garment form. The dyestuffs are preferably non-complexed acid dyes or 1:2 metal-complexed acid dyes prepared with chrome, iron, cobalt, copper, aluminum, or any transition metal.

The following general conditions are exemplary and not intended to be limiting. A dyebath is prepared at a volume equal to between about fifteen to about twenty times the weight of the articles to be dyed. Processing chemicals are added, including a chelating agent to prevent the deposition or complexing of metal ions in hard water, a dye leveling agent, and, in the case of metallized acid dyes, an acid donor to slowly lower the dyebath pH. The dyestuff is added, and the dyebath pH is adjusted to between about 5 and about 7 for acid dyes and to between about 8 and about 10 for metallized acid dyes. The dyebath solution is heated to the desired temperature, typically less than about 82° C. (180° F.), and typically between about 70° C. (158° F.) and about 80° C. (176° F.), at a rate of from about 0.5° C. to about 3.0° C. per minute and is held at that temperature for about 30 minutes to about 60 minutes. The dyebath is then cooled or emptied, and the articles are thoroughly rinsed with fresh water. The dyed articles are then aftertreated in a bath containing no added dye and dried in a tumble drier or in a vertical oven such as a Tenter or are passed over heater cans. The dyed articles may then be optionally heatset to improve dimensional stability.

A further understanding of this invention will be obtained from the following non-limiting Examples.

EXAMPLES

Material:

40/12 semidull yarn (40-denier yarn, 12 filaments) nylon-6 is knitted into tubes. The tubes were then dry heatset at 385° F. for 45 seconds in a horizontal oven. The dyes used were commercial acid dyes.

Dyeing Procedure:

The type of dyeing that was used in the following Examples is known as "exhaustion dyeing", where the fabric is circulated in the dyebath until maximum exhaustion of the dye from the dyebath to the fabric is achieved. The volume of the dyebath was calculated according to the weight of the fabric (knitted tube), and was referred to as the "liquor ratio". Liquor ratios of 15:1 (15 ml of dyebath for 1 gram of fabric) or 20:1 are conventionally used.

The dyebath was prepared by putting the amount of dyeing agents and dyes needed to dye a certain weight of fabric into a container according to the dyeing formulation. Then, hot distilled water is added to make up the right volume of dyebath for the dying. Water is heated to insure complete dissolution of the dyes. Usually, the pH of the dyebath was checked and adjusted as described in the dyeing procedure. Then, both fabric and the measured volume of dyebath were put into a stainless-steel dyeing container. The dyeing program was run in the laboratory-dyeing machine according to the dyeing procedure.

Aftertreatment Procedure:

The aftertreatment step was carried out in a manner similar to the dyeing procedure using the following technique:

15:1 bath ratio

Bath set with 2.0% Mesitol™ NBS (powder, predissolved 1:10 in very hot water)[1]

pH adjusted to 5.0 with acetic acid.

Bath heated to 77° C. (for Comparative Examples) or 50° C. (for Invention Examples) and run for 30 minutes Cool water rinse

[1]Mesitol™ NBS includes synthetic tanning agents, dye fixing agents, condensation products of aromatic sulfonic acids, including napthalene sulfonic acid, and formaldehyde or phenol, formaldehyde and sodium sulfite.

Example 1

Red (Comparative)

15:1 liquor ratio

Bath set cold with:

1.0% Uniperol™ NB-SE[2]

2.0% Ammonium Sulfate 2.0% lntracid™ Rhodamine B (CI.Acid red 52)

2.0% Intrazone™ Red G 190% (CI.Acid red 151)

[2]Uniperol™ NB-SE is an anionic leveling agent commercially available from BASF Textile Chemicals, Charlotte, N.C.

pH adjusted to 3.5 with acetic acid.

The bath temperature was raised to 210° F. (90° C.) at 3° F./min. and held for 45 minutes. The pH was checked and recorded at end of dyeing for all samples. The dyed samples were then cooled and rinsed.

The samples were then aftertreated in accordance with the aftertreatment procedure.

Example 2

Plum (Comparative)

15:1 liquor ratio

Bath cold with:

1.0% Uniperol NB-SE 0.25 g/l Trisodium phosphate 2.0 g/l Sandacid™ VS 0.387% (owf) Telon™ Blue BRL 200 (C.1. Acid Blue 324)[3]

0.880% (owf) Telon™ Fast Rubine A5BLW (C.1. Acid Red 299)

0.050% (owf) Nylanthrene™ Yellow FLW (C.1. Acid Yellow 159)[4]

[3]Telon™ dyes are commercially available from Dystar L.P., Charlotte, N.C.

[4]Nylanthlene dyes are commercially available from Crompton & Knowles Colors Inc., Charlotte, N.C.

The bath temperature was raised to 210° F. (98° C.) at 3° F./min. and held for 45 minutes, following which the samples were cooled and rinsed.

The sample was aftertreated in the same manner as Comparative Example 1.

Example 3

Turquoise (Comparative)

15:1 liquor ratio

Bath set cold with:

1.0% Uniperol NB-SE 0.25 g/l trisodium phosphate 2.0 g/l Sandacid™ VS[5]

1.0% Inatralite™ Turquoise 8GL (C.l. Direct Blue 76)

0.1% Supernylite™ Yellow 3G (No C.I. number)[6]

[5]Sandacid VS is an acid donor commercially available from Clariant Corporation, Charlotte, N.C.

[6]Intralite™ and Supernylite™ dyes are commercially available from Crompton & Knowles Colors Inc., Charlotte, N.C.

Bath temperature was raised to 210° F. (98° C.) at 3° F./min. and held for 45 minutes, following which the sample was cooled and rinsed.

The samples was aftertreated as in Comparative Example 1

Example 4

Black (Comparative)

15:1 liquor ratio

Bath set cold with:

1.0% Uniperol NB-SE 2.0% Ammonium Sulfate 3.0% Acidol™ Black MSRL (C.I. Acid Black 194)[7]

[7]Acidol™ dye is available commercially from BASF Textile Chemicals, Charlotte, N.C.

pH adjusted to 5.5 with Acetic Acid.

Bath temperature was raised to 210° F. (98° C.) at 3° F./min. and held for 45 minutes, following which the sample was cooled and rinsed.

Samples were aftertreated as in Example #1

Example 5

Hot Pink (Comparative)

15:1 liquor ratio

Bath set cold with:

1.0% Uniperol NB-SE 0.25 g/l Trisodium Phosphate 2.0% Intracid Rhodamine B pH was adjusted to 3.5 with acetic acid.

The temperature was raised to 210° F. (98° C.) at 3° F./min. and held for 45 minutes, following which the sample was cooled and rinsed.

The sample was aftertreated as in Comparative Example 1.

Example 6

Orange (Comparative)

15:1 liquor ratio

Bath set cold with:

1.0% Uniperol NB-SE 2.0% Acetic Acid 1.6% Intraacid Rhodamine B 0.70% Acidol™ Brilliant Yellow 8GX-N (C.I. Acid Yellow 184)

The temperature was raised to 210° F. (98° C.) at 3° F./min. and held for 45 minutes, following which the sample was cooled and rinsed.

The sample was aftertreated as in Comparative Example 1.

Examples 7–12 (Invention)

Examples 1–6 were repeated except that the samples were dyed at 80° C. and were aftertreated at 50° C.

Test Methods:

The samples of Examples 1–12 were subjected to the following tests:

A. Cigar Bleed Test

1. Prepare one 2:×6: piece of fabric from each dye d sample to be tested.
2. Prepare one 2"×6" piece of scoured white 100% polyamide-6 fabric for each sample to be tested.
3. Identify either the sample or the 100% polyamide-6 material with black Sanford pen.
4. Fully saturate the sample and the white material in deionized water.
5. Lay the white material on top of the dyed sample and roll into a "cigar" shape with the white material to the in side.
6. Place into a vial and close—let remain in the closed vial at room temperature (24° C. +/−3° C.) for 24 hours.
7. Remove from vial, unroll and separate the dyed sample and white fabric from each other. Lay flat on a non-absorbent surface to dry.
8. Rate the dye bleed on the side of the stained fabric that was in contact with the dyed sample using the AATCC (American Association of Textile Chemist and Colorists) Color Transference Scale. Alternately, stained cigar bleed test samples are measured on the ACS Spectrophotometer using large area view, specular component included, D65 10 degrees, 4 measurements per sample and rotating between 90 degrees between measurements. C.I.E. Delta E* values are calculated between an unstained white fabric and the stained samples.

B. Colorfastness to Laundering: AATCC Test Method 61-1996, Colorfastness to Laundering, Home and Commercial: Accelerated wash test condition IIA. A double thickness of dyed knitted tube is used. The degree of bluing of the hot pink shade is reported as C.I.E., b* values.

C. Perspiration Colorfastness: AATCC Test Method 15-1997, Colorfastness to Perspiration. A double thickness of dyed knitted tube is used.

The test results appear in the accompanying Tables I and II below.

TABLE I

Cigar Bleed and Perspiration Colorfastness

| Ex. No. | Cigar Bleed ( )E*) | Perspiration Fastness |
|---|---|---|
| 1 | 69.3 | 48.62 |
| 2 | 19.1 | 15.25 |
| 3 | 1.5 | — |
| 4 | 5.1 | — |
| 5 | 23.5 | 36.2 |
| 6 | 24.9 | 24.12 |
| 7 | 40.5 | 34.99 |
| 8 | 4.8 | 7.12 |
| 9 | 0.4 | — |
| 10 | 2.0 | — |
| 11 | 2.5 | 13.6 |
| 12 | 5.4 | 12.96 |

TABLE II

Shade Change Comparison

| | b* Values | | |
|---|---|---|---|
| Ex. No. | Dyed | Aftertreatment | IIA wash |
| 5 | 0.2 | 5.4 | −16.6 |
| 6 | 40.9 | 28.7 | 21.93 |
| 11 | 0.3 | 2.1 | −10.5 |
| 12 | 40.0 | 35.5 | 24.6 |

TABLE III

Bluing of Hot Pink Shade

| | b* Values | | |
|---|---|---|---|
| Ex. No. | Dyed | Aftertreatment | IIA wash |
| 5 | −8.7 | −15.0 | −25.5 |
| 11 | −9.0 | −12.2 | −21.9 |

As can be seen from the data above, the relatively low temperature dyeing and aftertreatment according to the present invention achieve dramatically improved dye bleed and perspiration performance characteristics, as well as reduced color change (bluing) of fluorescent dyed polyamide-6 fibers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of making improved colorfast articles having dyed polyamide 6 fibers comprising:

(i) bringing an article comprising undyed polyamide 6 fibers into contact with a dyebath comprising an amount of dye sufficient to impart color to the polyamide 6 fibers in the article at a dyebath temperature of between about 70° C. to about 80° C. and for a time sufficient to allow substantially maximum exhaustion of at least about 75% to about 100% uptake of the dye in the dyebath to the article; and then (ii) subjecting the article to an aftertreatment bath comprising acid dye fixing agents at an aftertreatment bath temperature of about 50° C. or lower.

2. The method of claim 1, wherein the dyebath of step (i) has a liquor ratio of between about 15:1 to about 20:1.

3. The method of claim 1, wherein step (i) includes circulating the article within the dyebath.

4. The method of claim 1, wherein the acid dye fixing agents are present in the dye bath in an amount of 2% by weight predissolved in water at a ratio of 1:10.

5. The method of claim 1, wherein step (i) includes adjusting the dyebath pH to be acidic.

6. The method of claim 5, wherein the pH of the dyebath is adjusted by the addition of acetic acid.

7. An article dyed according to the method of any one of claims 1–6.

8. The article of claim 7, in the form of fibers, yarns and/or fabrics.

* * * * *

UNITED STATES PATENT AND TRADEMARK OFFICE

CERTIFICATE OF CORRECTION

PATENT NO. : 6,497,731 B1 
DATED : December 24, 2002
INVENTOR(S) : N. Berthelon, D. Gadoury and T. Karageorgiou It is certified that error appears in the above-identified patent and that said Letters Patent is hereby corrected as shown below:

Title page,
Item [57], ABSTRACT,
Line 11, delete "5ºC" after "about" and replace it with -- 50ºC --.

Signed and Sealed this

Eighteenth Day of March, 2003

JAMES E. ROGAN
*Director of the United States Patent and Trademark Office*